US006705292B2

(12) United States Patent
Bugos

(10) Patent No.: US 6,705,292 B2
(45) Date of Patent: Mar. 16, 2004

(54) APPARATUS AND METHOD OF CONNECTING A FUEL INJECTOR AND A FUEL RAIL

(75) Inventor: Stephen C. Bugos, Poquoson, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 15 days.

(21) Appl. No.: 10/112,768

(22) Filed: Apr. 2, 2002

(65) Prior Publication Data

US 2003/0183200 A1 Oct. 2, 2003

(51) Int. Cl.[7] ..... F02M 55/02
(52) U.S. Cl. ..... 123/470; 123/456
(58) Field of Search ..... 123/470, 468–69, 123/456

(56) References Cited

U.S. PATENT DOCUMENTS

| | | | | |
|---|---|---|---|---|
| 4,984,548 A | * | 1/1991 | Hudson, Jr. | 123/470 |
| 5,035,224 A | * | 7/1991 | Hornby et al. | 123/470 |
| 5,136,999 A | | 8/1992 | Bassler et al. | 123/470 |
| 5,167,213 A | | 12/1992 | Bassler et al. | 123/470 |
| 5,301,647 A | * | 4/1994 | Lorraine | 123/470 |
| 5,350,314 A | | 9/1994 | Saba | 439/378 |
| 5,394,850 A | * | 3/1995 | Murphy et al. | 123/470 |
| 5,520,151 A | | 5/1996 | Gras et al. | 123/470 |
| 5,724,946 A | * | 3/1998 | Franchitto | 123/470 |
| 5,893,351 A | | 4/1999 | Akutagawa et al. | 123/470 |
| 6,019,089 A | * | 2/2000 | Taylor et al. | 123/470 |
| 6,374,809 B2 | * | 4/2002 | Satou | 123/470 |
| 6,481,420 B1 | * | 11/2002 | Panasuk et al. | 123/470 |

* cited by examiner

*Primary Examiner*—Thomas N. Moulis

(57) ABSTRACT

A mounting arrangement includes a fuel injector, a fuel injector cup, and a fastener. The fuel injector includes a body that defines an interior fuel passage that extends between an inlet and an outlet. The body of the fuel injector also includes first and second exterior grooves. The first exterior groove receives a compliant seal, and the second exterior groove is located between the first groove and the outlet. The fuel injector cup includes an end that defines an aperture through which passes along an axis the inlet of the fuel injector. The fuel injector cup also includes inner and outer surfaces. The inner surface contiguously engages the compliant seal, and the outer surface includes a shoulder that faces generally opposite the end of the fuel injector cup. The fastener includes first and second portions. The first portion engages the second exterior groove on the body of the fuel injector, and the second portion engages the shoulder on the outer surface of the fuel injector cup so as to axially retain the fuel injector relative to the fuel injector cup. The first portion is axially spaced from the second portion such that a first axial measurement between the first portion of the fastener and the compliant seal exceeds a second axial measurement between the end of the fuel injector cup and the shoulder on the outer surface of the fuel injector cup. Details of the fastener and a method for using the mounting arrangement are also included.

25 Claims, 5 Drawing Sheets

APPARATUS AND METHOD OF CONNECTING A FUEL INJECTOR AND A FUEL RAIL

FIELD OF THE INVENTION

This disclosure relates to a fastener, a mounting arrangement, and a method for connecting a fuel injector with respect to a fuel rail, and more particularly, for orienting the fuel injector with respect to the fuel rail.

BACKGROUND OF THE INVENTION

Fuel can be supplied to an internal combustion engine by way of a fuel rail assembly that can include a fuel rail and at least one fuel injector. The fuel injectors can be coupled to the fuel rail with clips. When a clip is used to couple an injector to a cup, it is believed that there are at least two different types of forces that are required: the forces required to compress a sealing member between the cup and the injector, and the forces required to engage the clip with respect to the injector and the cup. It is believed that known clips concurrently apply both types of forces. Consequently, it is believed that these known clips suffer from a number of disadvantages including improperly compressing the sealing member and improperly securing the injector with respect to the cup.

It is believed that there is a need to provide a clip that overcomes the disadvantages of known clips.

SUMMARY OF THE INVENTION

The present invention provides a clip for fastening a fuel injector to a fuel injector cup of a fuel injection system. The fuel injector cup includes an end, an inner surface, and an outer surface defining a shoulder. And the fuel injector includes an exterior groove and an O-ring that is adapted to sealingly engage the inner surface of the fuel injection cup. The clip includes first and second portions. The first portion engages the exterior groove on the fuel injector. And the second portion engages the shoulder on the outer surface of the fuel injector cup so as to retain along an axis the fuel injector relative to the fuel injector cup. The first portion is axially spaced from the second portion such that a first axial measurement between the first portion and the O-ring exceeds a second axial measurement between the end of the fuel injector cup and the shoulder on the outer surface of the fuel injector cup.

The present invention also provides a mounting arrangement for a fuel rail. The mounting arrangement includes a fuel injector, a fuel injector cup, and a fastener. The fuel injector includes a body that defines an interior fuel passage that extends between an inlet and an outlet. The body of the fuel injector also includes first and second exterior grooves. The first exterior groove receives a compliant seal, and the second exterior groove is located between the first groove and the outlet. The fuel injector cup includes an end that defines an aperture through which passes along an axis the inlet of the fuel injector. The fuel injector cup also includes inner and outer surfaces. The inner surface contiguously engages the compliant seal, and the outer surface includes a shoulder that faces generally opposite the end of the fuel injector cup. The fastener includes first and second portions. The first portion engages the second exterior groove on the body of the fuel injector, and the second portion engages the shoulder on the outer surface of the fuel injector cup so as to axially retain the fuel injector relative to the fuel injector cup. The first portion is axially spaced from the second portion such that a first axial measurement between the first portion of the fastener and the compliant seal exceeds a second axial measurement between the end of the fuel injector cup and the shoulder on the outer surface of the fuel injector cup.

The present invention also provides a method of securing a fuel injector to a fuel rail. The fuel injector is displaceable along an axis with respect to the fuel rail. The method includes providing the fuel injector with a clip and an O-ring, and engaging the fuel injector with respect to the fuel rail. The clip is adapted to secure the fuel injector with respect to the fuel rail. And the O-ring provides a fuel tight seal between the fuel injector and the fuel rail. The engaging the fuel injector with respect to the fuel rail occurs such that the O-ring establishes the fuel tight seal prior to the clip being coupled to the fuel rail.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
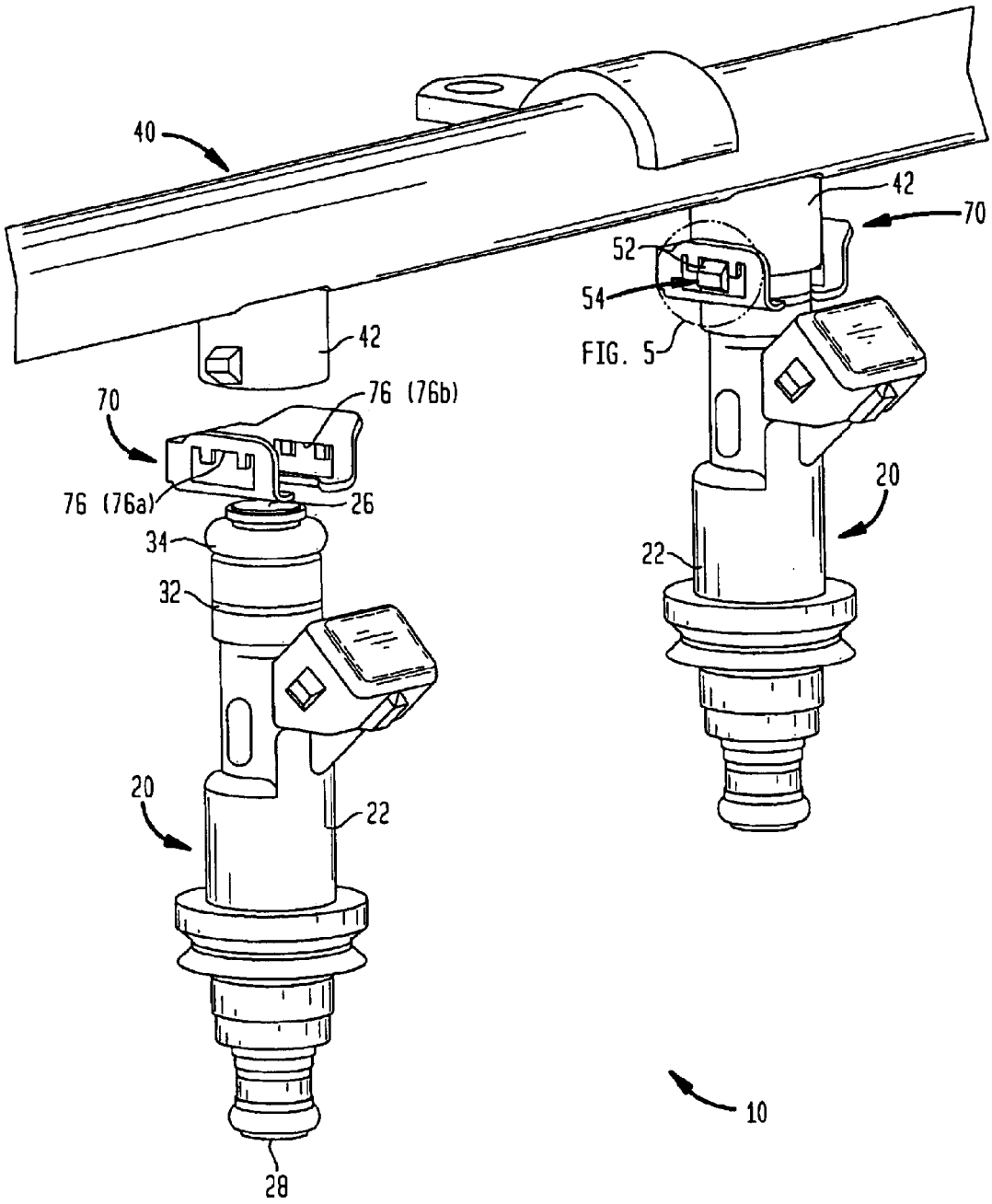
FIG. 1 is perspective view of a fuel rail assembly. The left side shows an exploded arrangement of a rail, injector, and clip in accordance with the present invention. The right side shows an assembled arrangement of a rail, injector, and clip in accordance with the present invention.
Figure 2:
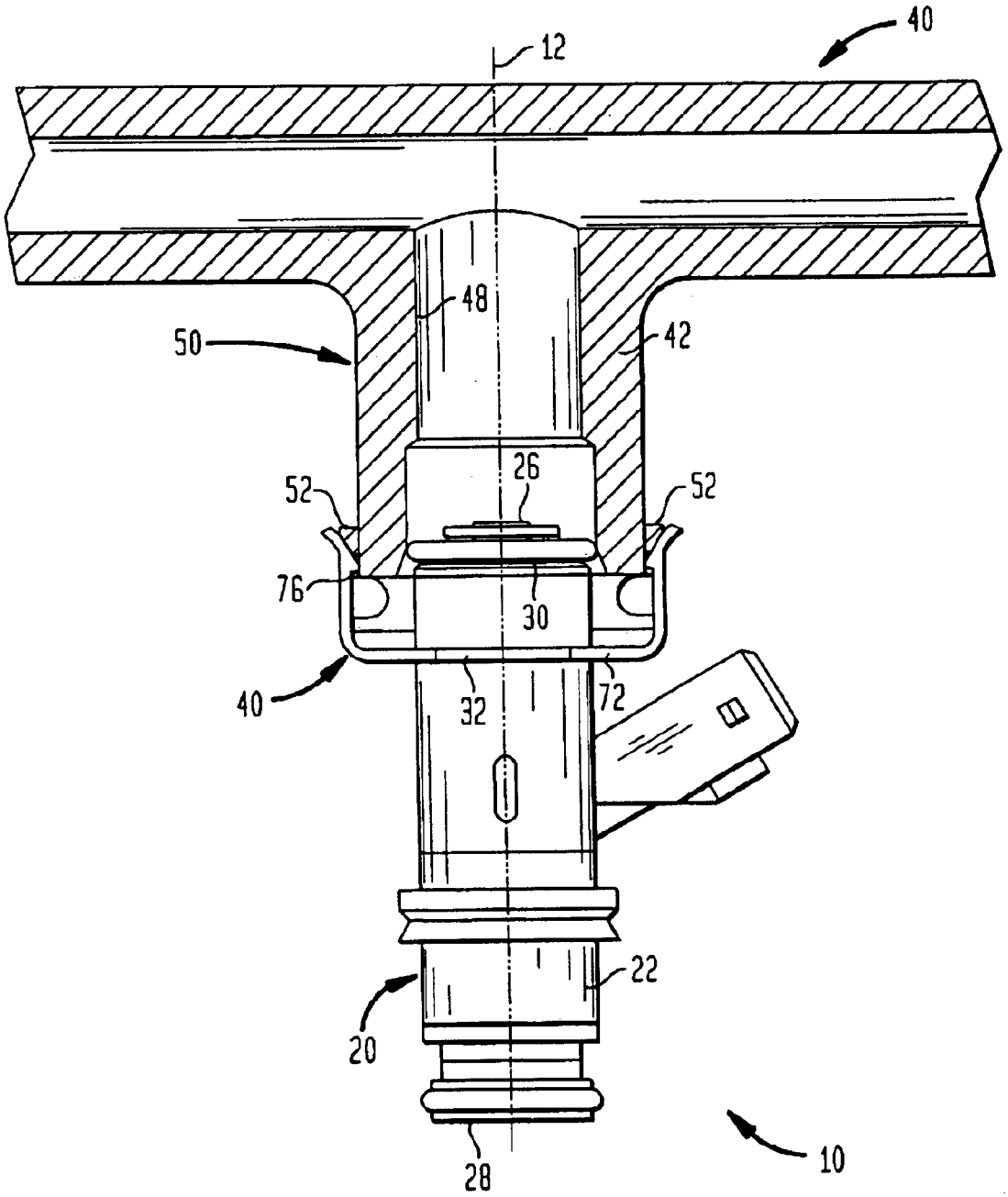
FIG. 2 is a partial cross sectional view of the fuel rail assembly shown in FIG. 1. The fuel injector, cup, and clip according to the present invention are shown in an intermediate state of assembly.
Figure 3:
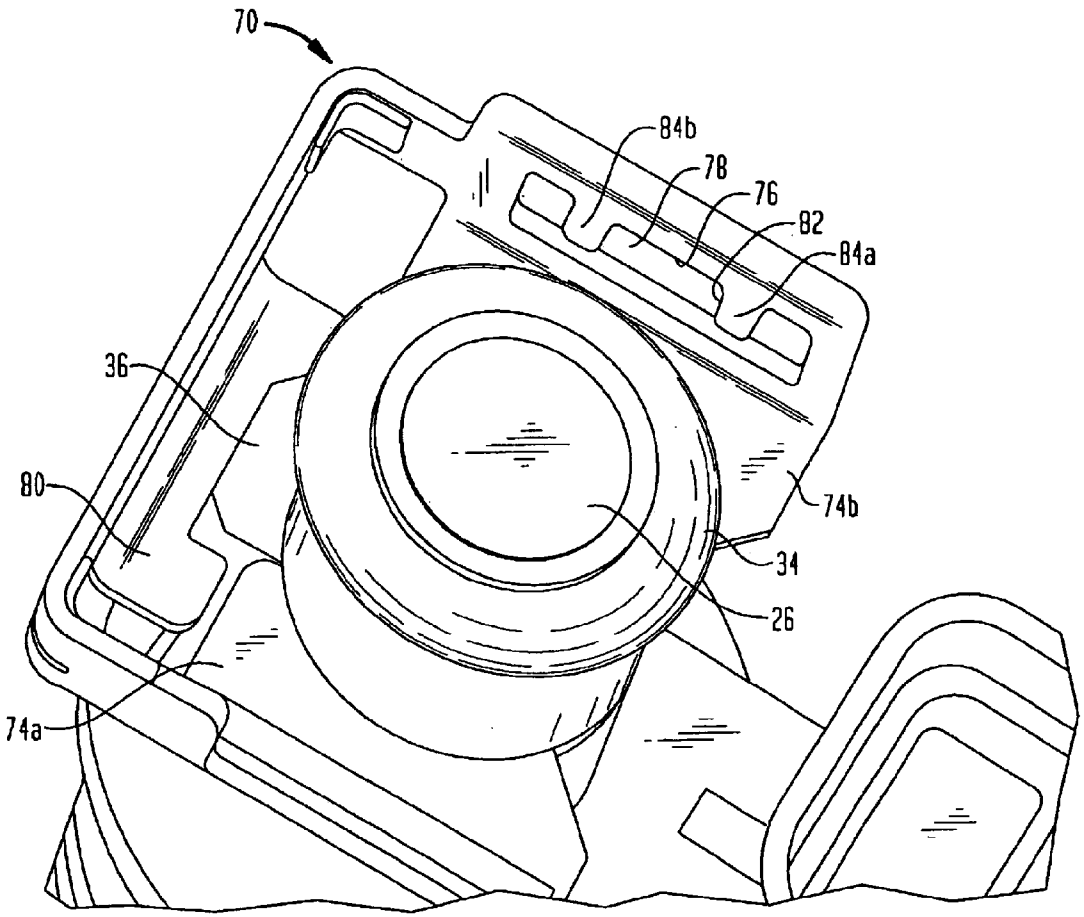
FIG. 3 is perspective view of the injector and clip shown in FIG. 1.
Figure 4:
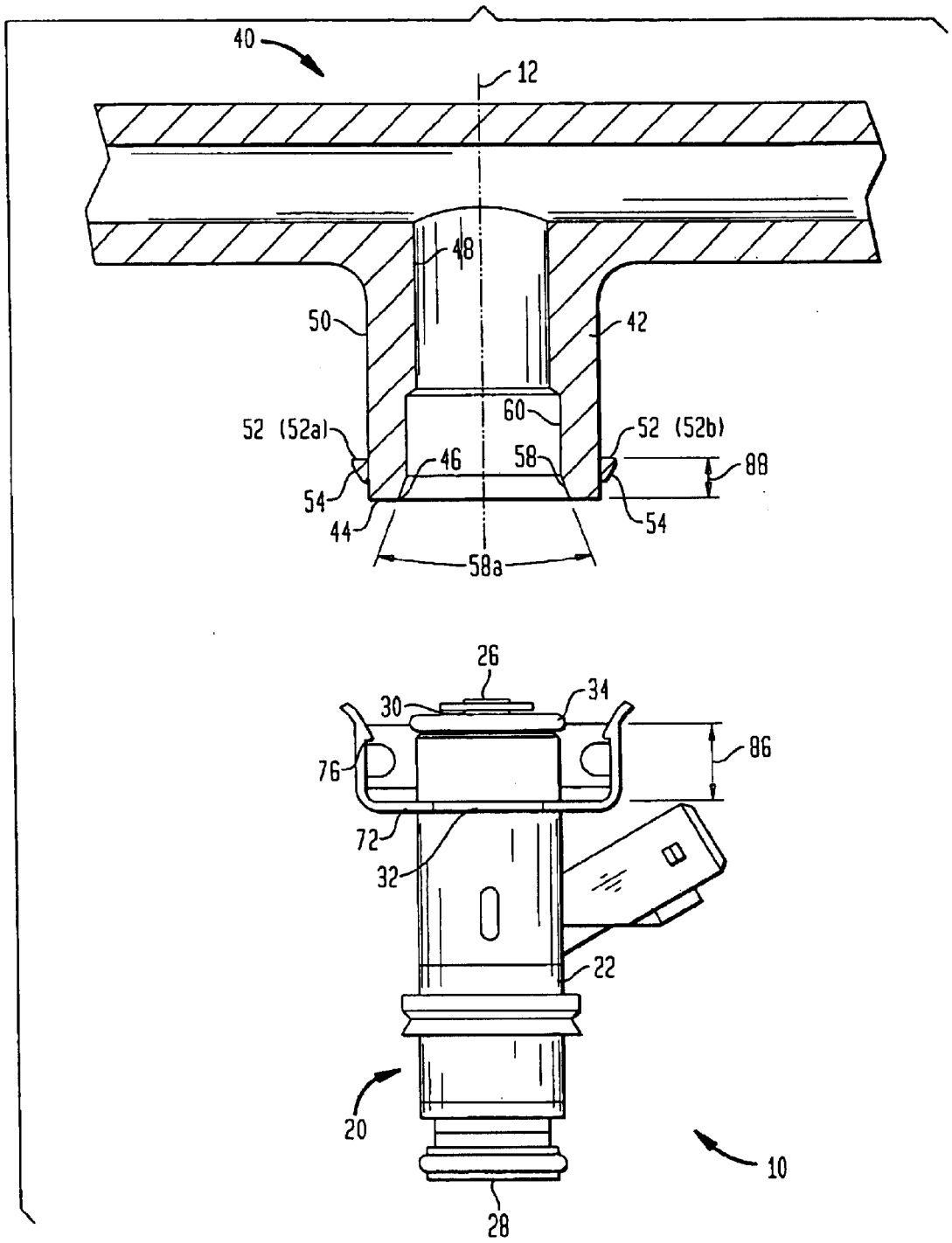
FIG. 4 is an exploded view of the fuel rail assembly shown in FIG. 1.
Figure 5:
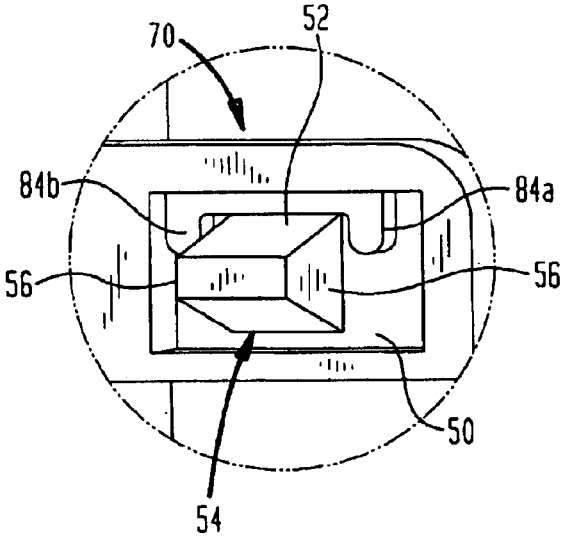
FIG. 5 is a perspective view showing a detail of the cup shown in FIG. 1
Figure 6:
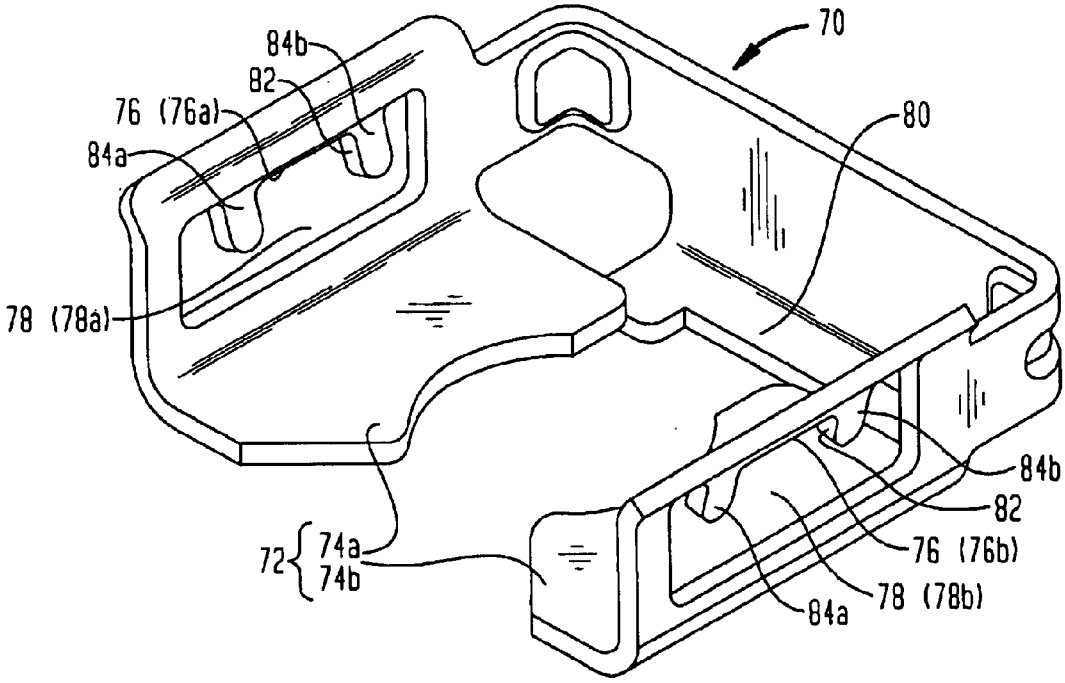
FIG. 6 is a perspective view of the clip shown in FIG. 1.

Referring to the figures, there is shown a mounting arrangement 10 according to the present invention. As used herein, like numerals indicate like elements throughout. The fuel mounting arrangement 10 includes a fuel injector 20 that is moved along an axis 12 into mating engagement with a fuel rail 40, and secured thereto with a fastener 70. The fastener 70 can be a clip.

The fuel injector 20 includes a body 22 that defines an interior fuel passage (not shown) that extends between an inlet 26 and an outlet 28. The body 22 of the fuel injector 20 also includes a first exterior groove 30 and a second exterior groove 32. The first exterior groove 30 receives a compliant seal 34. The compliant seal 34 can be an O-ring, for example. The second exterior groove 32, which may partially or completely circumscribe the body 22, is located axially between the first exterior groove 30 and the outlet 28. The body 22 may also be configured to angularly orient about the axis 12 the fastener 70 with respect to the fuel injector 20. For example, a tab 36 can extend from the body 22. Of course, different configurations, such as a recess, could also be used for achieving this angular orientation.

The fuel rail 40 provides fluid communication between at least one fuel injector cup 42 and a supply of fuel, e.g., a fuel tank (not shown). The fuel injector cup 42 includes an end 44 that defines an aperture 46. The inlet 26 of the fuel injector 20 is moved along the axis 12 such that it passes through the aperture 46 and inside an inner surface 48 of the fuel injector cup 42. The inner surface 48 contiguously engages the compliant seal 34. An outer surface 50 of the fuel injector cup 42 includes a shoulder 52 that faces generally opposite the end 44 of the fuel injector cup 42. According to a one embodiment, the shoulder 52 may be defined by a first surface on a protrusion 54. Of course, the surface 52 could also be defined otherwise, e.g., by a lateral face of a groove formed on the outer surface 50. The protrusion 54 also has opposing sides 56*a*,56*b* that may be used to angularly orient about the axis 12 the fastener 70 with respect to the fuel injector cup 42.

The inner surface 48 of the fuel injector cup 42 may include a chamfer 58 that is proximate the end 44. A range of the included angle 58*a* for the chamfer 58 with respect to the axis 12 is preferably 20° to 60°. A most preferred included angle 58*a* is approximately 40°. Such a chamfer 58 can facilitate the insertion of the fuel injector 20 into the fuel injector cup 42 by receiving and guiding the compliant seal 34 into sealing engagement with a non-chamfered portion 60 of the inner surface 48. In particular, the chamfer 58 provides gradual compression of the compliant seal 34.

The fastener 70 includes a first portion 72 that engages the second exterior groove 32 on the body 22 of the fuel injector 20. The first portion 72 includes a plurality of projections 74*a*,74*b* (two are shown) that resiliently engage the second exterior groove 32. Preferably, the projections 74*a*,74*b* include a pair of opposing projections, i.e., they generally oppose one another with respect to the axis 12.

The fastener 70 also includes a second portion 76 that engages the shoulder 52 on the outer surface 50 of the fuel injector cup 42. As such, the second portion 76 and the shoulder 52 cooperatively retain along an axis 12 the fuel injector 20 relative to the fuel injector cup 42. Preferably, a pair of second portions 76*a*,76*b* respectively engage a pair of shoulders 52*a*,52*b*, which are located on opposite sides of the axis 12.

The fastener 70 also includes a recess 78 that receives the protrusion 54, which can define the shoulder 52, when the second portion 76 engages the shoulder 52 on the outer surface 50 of the fuel injector cup 42. Preferably, a pair of recesses 78*a*,78*b* respectively engage the pair of shoulders 52*a*,52*b*, which are located on opposite sides of the axis 12.

The fastener 70 can also include a third portion 80 that engages the fuel injector 20 so as to prevent relative rotation about the axis 12 between the fastener 70 and the fuel injector 20.

The fastener 70 also includes a fourth portion 82 that engages the fuel injector cup 42 so as to prevent relative rotation about the axis 12 between the fastener 70 and the fuel injector cup 42. Preferably, the fourth portion 82 includes pairs of fingers 84*a*,84*b* that engage the opposing sides 56*a*,56*b* of the protrusion 54.

The first portion 72 of the fastener 70 is spaced from the second portion 76 such that a first axial measurement 86 (taken parallel to the axis 12) between the first portion 72 and the compliant seal 34 exceeds a second axial measurement 88 (also taken parallel to the axis 12) between the end 44 of the fuel injector cup 42 and the shoulder 52 on the outer surface 50 of the fuel injector cup 42.

According to a preferred embodiment, the first axial measurement 86 exceeds the second axial measurement 88 such that the compliant seal 34 initiates contiguously engagement with the inner surface 48 of the fuel injector cup 42 before the second portion 76 engages the shoulder 52 on the outer surface 50 of the fuel injector cup 42. And according to a more preferred embodiment, the first axial measurement 86 exceeds the second axial measurement 88 such that the compliant seal 34 is sealingly engaged with the inner surface 48 of the fuel injector cup 42 before the second portion 76 engages the shoulder 52 on the outer surface 50 of the fuel injector cup 42.

A method of securing the fuel injector 20 with respect to a fuel rail 40 in accordance with the present invention will now be described. The compliant seal 34, e.g., an O-ring, is installed in the first exterior groove 30 on the body 22 of the fuel injector 20. And the fastener 70, e.g., a clip, is coupled with respect to the fuel injector 20, e.g., the first portion 72 of the fastener 70 is inserted into the second exterior groove 32 on the body 22 of the fuel injector 20.

Next, the fuel injector 20 is displaced along the axis 12 such that the compliant seal 34 establishes a fuel tight seal between the body 22 of the fuel injector 20 and the inner surface 48 of the fuel injector cup 42. Moreover, this fuel tight seal is achieved prior to the fastener 70 being coupled to the fuel rail 40, i.e., before the second portion 76 of the fastener 70 engages the shoulder 52 on the outer surface 50 of the fuel injector cup 42.

According to a preferred embodiment, there are three stages of displacing along the axis 12 of the fuel injector 20 with respect to the fuel injector cup 42. First, the fuel injector 20 with the compliant seal 34 and the fastener 70 are displaced along the axis 12 to a first position relative to the fuel rail 40. The initial contact of the compliant seal 34 with both the body 22 of the fuel injector 20 and the inner surface 48 of the fuel injector cup 42 occurs in the first position. Second, the fuel injector 20 with the compliant seal 34 and the fastener 70 are further displaced along the axis 12 to a second position that is between the first position and the fuel rail 40. Compression of the compliant seal 34 between the body 22 of the fuel injector 20 and the inner surface 48 of the fuel injector cup 42 begins at the second position. And third, the fuel injector 20 with the compliant seal 34 and the fastener 70 are further displaced along the axis 12 to a third position that is between the second position and the fuel rail 40. The fastener 70 is coupled to the fuel injector cup 42, i.e., the second portion 76 engages the shoulder 52, at the third position.

Accordingly, this separates the forces associated with compressing the compliant seal 34 from the forces associated with fastening the fuel injector 20 to the fuel rail 40. Preferably, the compliant seal 34 is compressed past the chamfer 48 of the inner surface 48 of the fuel injector cup 42 before the second portion 76 of the fastener 70 makes contact with the protrusion 54 on the outer surface 50 of the fuel injector cup 42. Thus, the present invention ensures that the compliant seal provides a fuel tight seal between the fuel injector 20 and the fuel rail 40, and ensures the proper connection between the fuel injector 20 and the fuel rail 40.

According to the present invention it is also possible to establish a particular angularly orient about the axis 12 of the fuel injector 20 with respect to the fuel rail 40. In particular, the third portion 80 of the fastener 70 can cooperatively engage the tab 36 that extends from the body 22 of the fuel injector 20 so as to prevent relative rotation about the axis 12 between the fastener 70 and the fuel injector 20. Similarly, the pairs of fingers 84*a*,84*b* of the fourth portion 82 of the fastener 70 can cooperatively engage the opposing sides 56*a*,56*b* of the protrusion 54 so as to prevent relative rotation about the axis 12 between the fastener 70 and the fuel injector cup 42. Thus, the present invention can also ensure the relative orientation of the fuel injector 20 with respect to the fuel rail 40.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A clip for fastening a fuel injector to a fuel injector cup of a fuel injection system, the fuel injector cup including an end, an inner surface, and an outer surface defining a shoulder, and the fuel injector including an exterior groove and a O-ring adapted to sealingly engage the inner surface of the fuel injection cup, the clip comprising:

a first portion engaging the exterior groove on the fuel injector; and a second portion engaging the shoulder on the outer surface of the fuel injector cup so as to retain along an axis the fuel injector relative to the fuel injector cup, the first portion being axially spaced from the second portion such that a first axial measurement between the first portion and the O-ring exceeds a second axial measurement between the end of the fuel injector cup and the shoulder on the outer surface of the fuel injector cup.

2. The clip according to claim 1, further comprising:

a recess adapted to receive a protrusion defining the shoulder when the second portion engages the shoulder on the outer surface of the fuel injector cup.

3. The clip according to claim 1, further comprising:

a third portion adapted to engage the fuel injector so as to prevent relative rotation about the axis between the fastener and the fuel injector.

4. The clip according to claim 3, further comprising:

a fourth portion adapted to engage the fuel injector cup so as to prevent relative rotation about the axis between the fastener and the fuel injector cup.

5. The clip according to claim 4, wherein the fourth portion comprises a recess adapted to receive a protrusion defining the shoulder.

6. The clip according to claim 5, wherein the fourth portion comprises a pair of fingers adapted to engage opposite sides of the protrusion.

7. The clip according to claim 4, wherein the fourth portion comprises a plurality of recesses adapted to receive corresponding protrusions defining the shoulder.

8. The clip according to claim 1, wherein the first portion comprises a plurality of projections adapted to resiliently engage the exterior groove of the fuel injector.

9. The clip according to claim 8, wherein the first portion comprises a pair of opposing projections.

10. A mounting arrangement for a fuel rail, the mounting arrangement comprising:

a fuel injector including a body defining an interior fuel passage extending between an inlet and an outlet, the body of the fuel injector including first and second exterior grooves, the first exterior groove receiving a compliant seal, and the second exterior groove being located between the first groove and the outlet;

a fuel injector cup including an end defining an aperture through which passes along an axis the inlet of the fuel injector, the fuel injector cup also including inner and outer surfaces, the inner surface contiguously engaging the compliant seal, and the outer surface including a shoulder facing generally opposite the end of the fuel injector cup; and a fastener including first and second portions, the first portion engaging the second exterior groove on the body of the fuel injector, and the second portion engaging the shoulder on the outer surface of the fuel injector cup so as to axially retain the fuel injector relative to the fuel injector cup, the first portion being axially spaced from the second portion such that a first axial measurement between the first portion of the fastener and the compliant seal exceeds a second axial measurement between the end of the fuel injector cup and the shoulder on the outer surface of the fuel injector cup.

11. The mounting arrangement according to claim 10, wherein the first axial measurement exceeds the second axial measurement such that the compliant seal initiates contiguously engagement with the inner surface of the fuel injector cup before the second portion engages the shoulder on the outer surface of the fuel injector cup.

12. The mounting arrangement according to claim 11, wherein the first axial measurement exceeds the second axial measurement such that the compliant seal is sealingly engaged with the inner surface of the fuel injector cup before the second portion engages the shoulder on the outer surface of the fuel injector cup.

13. The mounting arrangement according to claim 10, wherein the second exterior groove circumscribes the body of the fuel injector, and the first portion of the fastener comprises a plurality of projections resiliently engaging the second exterior groove on the body of the fuel injector.

14. The mounting arrangement according to claim 10, wherein the outer surface of the fuel injector cup comprises a protrusion defining the shoulder, and the fastener comprises a recess receiving the protrusion when the second portion engages the shoulder on the outer surface of the fuel injector cup.

15. The mounting arrangement according to claim 10, wherein the fastener comprises a third portion engaging the body of the fuel injector so as to prevent relative rotation about the axis between the fastener and the fuel injector.

16. The mounting arrangement according to claim 15, wherein the outer surface of the fuel injector cup comprises a protrusion, and the fastener comprises a recess receiving the protrusion so as to prevent relative rotation about the axis between the fastener and the fuel injector cup.

17. The mounting arrangement according to claim 10, wherein the first exterior groove circumscribes the body of the fuel injector, and the compliant seal comprises an O-ring.

18. The mounting arrangement according to claim 10, wherein the inner surface of the fuel injector cup comprises a chamfer at the end of the fuel injector cup.

19. The mounting arrangement according to claim 18, wherein the first axial measurement exceeds the second axial measurement such that the compliant seal initiates contiguously engagement with the chamfer of the inner surface of the fuel injector cup before the second portion engages the shoulder on the outer surface of the fuel injector cup.

20. The mounting arrangement according to claim 19, wherein the first axial measurement exceeds the second axial measurement such that the compliant seal sealingly engages a non-chamfered section of the inner surface of the fuel injector cup before the second portion engages the shoulder on the outer surface of the fuel injector cup.

21. The mounting arrangement according to claim 18, wherein the chamfer defines an included angle between 20° and 60° with respect to the axis.

22. The mounting arrangement according to claim 21, wherein the chamfer defines an included angle of approximately 40° with respect to the axis.

23. A method of securing a fuel injector to a fuel rail, the fuel injector being displaceable along an axis with respect to the fuel rail, the method comprising:

providing the fuel injector with a clip and an O-ring, the clip being adapted to secure the fuel injector with respect to the fuel rail, and the O-ring providing a fuel tight seal between the fuel injector and the fuel rail;

engaging the fuel injector with respect to the fuel rail such that the O-ring establishes the fuel tight seal prior to the clip being coupled to the fuel rail;

wherein the providing the fuel injector with the clip comprises coupling the clip to the fuel injector; and the engaging the fuel injector comprises:

displacing the fuel injector with the clip and O-ring along the axis to a first position relative to the fuel rail, the displacing to the first position initiating contact of the O-ring with the fuel injector and with the fuel rail;

displacing the fuel injector with the clip and O-ring along the axis to a second position relative to the fuel rail, the displacing to the second position initiating compression of the O-ring between the fuel injector and the fuel rail, the second position being between the first position and the fuel rail; and displacing the fuel injector with the clip and O-ring along the axis to a third position relative to the fuel rail, the displacing to the third position coupling the clip with the fuel rail, the third position being between the second position and the fuel rail.

24. The method according to claim 23, wherein the coupling the clip with respect to the fuel injector comprises angularly orienting about the axis the clip with respect to the fuel injector.

25. The method according to claim 23, wherein the displacing to the third position comprises angularly orienting about the axis the clip with respect to the fuel rail.

* * * * *